US005743620A

United States Patent [19]

Rojas et al.

[11] Patent Number: 5,743,620

[45] Date of Patent: Apr. 28, 1998

[54] BODY WORN LIGHTED DRINKING RECEPTACLE

[76] Inventors: Michael Rojas; Marilyn Arnodo, both of 601 W. 17th, #2, Houston, Tex. 77008

[21] Appl. No.: 822,745

[22] Filed: Mar. 24, 1997

[51] Int. Cl.[6] ..... F21V 33/00

[52] U.S. Cl. ..... 362/101; 362/396; 362/191; 362/154

[58] Field of Search ..... 362/101, 154, 362/190, 191, 103, 396, 351; 248/102, 103

[56] References Cited

U.S. PATENT DOCUMENTS

| | | | |
|---|---|---|---|
| 4,836,476 | 6/1989 | Wolf | 248/146 |
| 4,890,205 | 12/1989 | Shaffer | 362/154 |
| 4,922,355 | 5/1990 | Dietz et al. | 362/101 |
| 5,119,279 | 6/1992 | Makowsky | 362/101 |
| 5,135,189 | 8/1992 | Ghazizadeh | 248/104 |
| 5,178,450 | 1/1993 | Zelensky et al. | 362/101 |
| 5,440,465 | 8/1995 | Hasness | 362/396 |
| 5,575,553 | 11/1996 | Tipton | 362/154 |
| 5,662,406 | 9/1997 | Mattice et al. | 362/101 |

*Primary Examiner*—Thomas M. Sember
*Attorney, Agent, or Firm*—Henderson & Sturm

[57] ABSTRACT

An illuminated drinking receptacle 10 designed to be suspended from the belt 50 of a user by a belt clip unit 13. The drinking receptacle 10 includes a generally translucent receptacle member 20 having an illumination source 31 operatively associated with its bottom portion, and an opaque upper portion 24 which blocks the transmission of light from the illumination source 31.

5 Claims, 1 Drawing Sheet

BODY WORN LIGHTED DRINKING RECEPTACLE

BACKGROUND OF THE INVENTION

1. Field of the Invention

The present invention relates to the field of illuminated drinking receptacles in general, and in particular to an illuminated drinking receptacle that is designed to be suspended from the user's person.

2. Description of Related Art

As can be seen by reference to the following U.S. Pat. Nos. 4,836,476; 4,922,355; 5,119,279; and 5,178,450, the prior art is replete with myriad and diverse illumination means for drinking receptacles.

While all of the aforementioned prior art constructions are more than adequate for the basic purpose and function for which they have been specifically designed, none of the patented devices can fulfill the role that is intended for the subject matter of the present invention.

As most bicycle riders are aware, the most dangerous time period for riding a bike is between dusk and dawn when low light to no light conditions exist. To this end, bike riders have in the past resorted to applying light reflectors and powered lights to both their clothing and their bicycles in an effort to increase their visibility to automotive vehicles.

As a consequence of the foregoing situation, there has existed a long standing need among bicyclists for an illuminated drinking receptacle that can be suspended from the bicyclist person to provide an additional safety factor for the bicyclist. The provision of such a construction is a stated objective of the present invention.

BRIEF SUMMARY OF THE INVENTION

Briefly stated, the lighted drinking receptacle that forms the basis of the present invention comprises in general, a receptacle unit, an illumination unit and a belt clip unit. The belt clip unit is formed integrally with the receptacle unit and the illumination unit is detachably secured to the receptacle unit.

As will be explained in greater detail further on in the specification, the lighted drinking receptacle of this invention is designed to provide a unique source of illumination to a bicycle rider. Both the contents of the receptacle unit and the receptacle unit itself will transmit reflected light from the illumination unit that will be visible to the operators of motor vehicles.

In addition, the illumination effect will be at its most pronounced and visible stage at precisely the same time interval when the bike rider needs it the most, which is when the rider is dividing their attention (however slightly) during the act of drinking from the receptacle.

BRIEF DESCRIPTION OF THE SEVERAL VIEW OF THE DRAWING

These and other attributes of the invention will become more clear upon a thorough study of the following description of the best mode for carrying out the invention, particularly when reviewed in conjunction with the drawings, wherein:

FIG. 1 is a rear plan view of the illuminated drinking receptacle that forms the basis of the present invention; and FIG. 2 is a partial cut-away side view of the drinking receptacle.

DETAILED DESCRIPTION OF THE INVENTION

Figure 1:
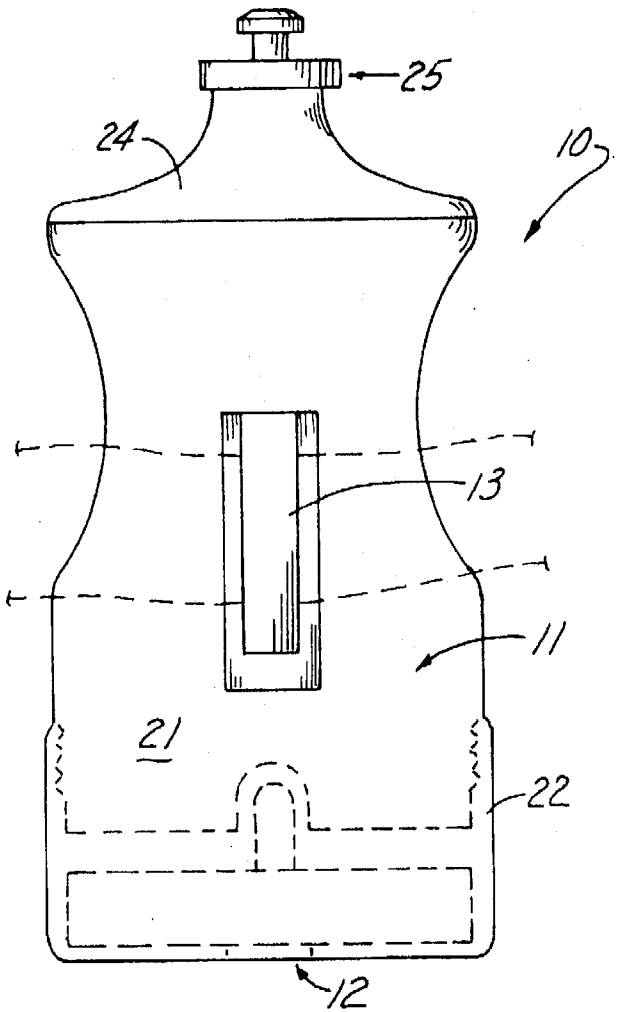

Referring now to the drawings, wherein like reference numerals designate identical or corresponding parts throughout the several views, FIG. 1 shows the invention depicted generally at 10 and comprising in general a receptacle unit 11, an illumination unit 12, and a belt clip unit 13. These units will now be described in seriatim fashion.

Figure 2:
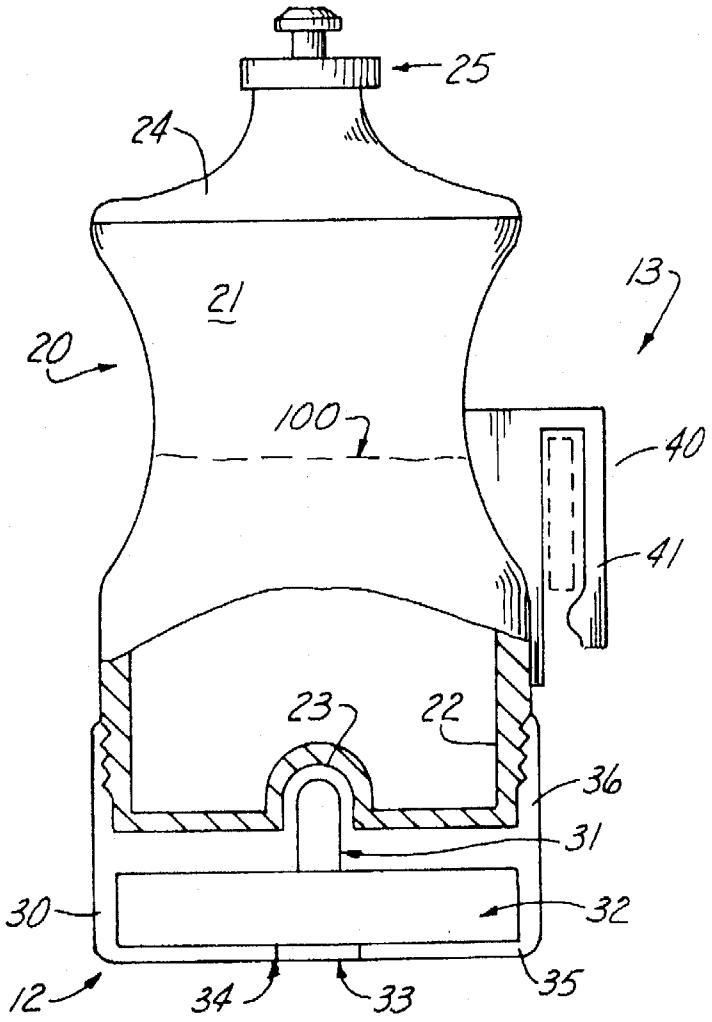

As shown in FIGS. 1 and 2, the receptacle unit 11 comprises an elongated contoured receptacle member 20 fabricated from a translucent plastic 21 or the like. The bottom portion of the receptacle member 20 is threaded as at 22 and provided with a central recess 23. In addition, the upper potion 24 of the receptacle member 20 is opaque and provided with a conventional pop-up closure element 25.

As can best be seen by reference to FIG. 2, the illumination unit 12 comprises a generally truncated, cylindrical base member 30 containing an illumination source 31 provided with a power supply 32 and having a push button switch 33 which extends through an aperture 34 formed in the bottom 35 of the base member 30.

In addition, the base member 30 is further provided with internally threaded raised sidewalls 36 which engage the threaded portion 22 of the receptacle member 20 to position the illumination source 31 within the central recess 23 in the bottom of the receptacle member 20.

Still referring to FIG. 2, it can be seen that the belt clip unit 13 comprises a belt clip member 40 having a downwardly depending contoured belt clip arm 41 which cooperates with the belt clip member 40 to captively engage a portion of a bike rider's belt 50 in a well recognized fashion.

In the preferred embodiment of the invention depicted in the drawings, the belt clip unit 13 is formed integrally with the receptacle member 20. However, it is to be understood that this invention also contemplates having the belt clip unit 13 fabricated independently of the receptacle unit 11 and then permanently affixed thereto.

At this juncture, it should also be noted that substantially the entire receptacle member is fabricated from a fluorescent plastic material 21 to enhance the light transmission properties of the receptacle member 20 and the liquid 100 contained therein. It should further be noted that this invention 10 works best with clear or substantially translucent liquids such as water, pale sodas and citrus based electrolyte replenishing drinks as opposed to the darker liquids such as cola based sodas or the like which would substantially diminish the light transmitting potential of the invention.

It should further be appreciated that the primary reason for making the top portion 24 of the receptacle member 20 opaque is to block the light coming from the illumination source 31 from reaching the user's eyes, and destroying their night vision as the user drinks from the receptacle member 20.

Although only an exemplary embodiment of the invention has been described in detail above, those skilled in the art will readily appreciated that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

We claim:

1. An illuminated drinking receptacle for use with a belt which encircles a user's torso wherein the drinking receptacle comprises:

a contoured receptacle member including an upper portion provided with a closure element, an intermediate portion, and a bottom portion wherein both the upper portion and the closure element are opaque and the intermediate and bottom portions of the receptacle member are fabricated from a translucent material;

an illumination unit operatively associated with the bottom portion of the receptacle member; and a belt clip unit disposed on the intermediate portion of the receptacle member for releasably connecting the receptacle member to the belt.

2. The illuminated drinking receptacle as in claim 1 wherein the bottom portion of the receptacle member has a threaded external periphery and a central recess.

3. The illuminated drinking receptacle as in claim 2 wherein the illumination unit includes a base member having an illumination source, a power supply operatively associated with the illumination source, and a switch for controlling the power supply.

4. The illuminated drinking receptacle as in claim 3 wherein at least a portion of said illumination source is received in the central recess in the bottom portion of the receptacle member.

5. The illuminated drinking receptacle as in claim 1 wherein the closure element comprises a pop-up style closure element.

* * * * *